United States Patent [19]

Miyaoka et al.

[11] Patent Number: 4,705,378

[45] **Date of Patent: * Nov. 10, 1987**

[54] AUTOMATIC PROCESSING MACHINE FOR PHOTOGRAPHY

[75] Inventors: Kazuyoshi Miyaoka; Kazuhiro Kobayashi; Satoru Kuse; Masayuki Kurematsu; Shigeharu Koboshi, all of Hino, Japan

[73] Assignee: Konishiroku Photo Ind. Co., Ltd., Tokyo, Japan

[ * ] Notice: The portion of the term of this patent subsequent to Nov. 10, 2004 has been disclaimed.

[21] Appl. No.: 719,356

[22] Filed: Apr. 3, 1985

[30] Foreign Application Priority Data

Apr. 9, 1984 [JP] Japan ..... 59-69161

[51] Int. Cl.[4] ..... G03D 3/06

[52] U.S. Cl. ..... 354/324; 354/328

[58] Field of Search ..... 354/324, 331, 328, 319, 354/320, 321, 322; 137/563

[56] References Cited

U.S. PATENT DOCUMENTS

| | | | |
|---|---|---|---|
| 3,000,288 | 9/1961 | Winnek | 354/328 |
| 3,332,435 | 7/1967 | Anderson et al. | 137/563 |
| 3,623,416 | 11/1971 | Anderberg | 354/324 |
| 3,990,088 | 11/1976 | Takita | 354/324 |
| 4,035,818 | 7/1977 | King | 354/331 |
| 4,081,816 | 3/1978 | Geyken et al. | 354/324 |
| 4,215,719 | 8/1980 | Laar et al. | 137/563 |
| 4,362,377 | 12/1982 | Yoshida et al. | 354/328 |
| 4,518,240 | 5/1985 | Taylor et al. | 354/324 |

FOREIGN PATENT DOCUMENTS

| | | | |
|---|---|---|---|
| 943653 | 12/1963 | United Kingdom | 354/339 |

*Primary Examiner*—A. A. Mathews

*Attorney, Agent, or Firm*—Frishauf, Holtz, Goodman & Woodward

[57] ABSTRACT

An automatic processing machine for photography which performs developing processing of a photographic light-sensitive material automatically while replenishing a replenisher solution from a replenisher tank to a processing solution tank. A pipe having orifices therein is arranged approximately centrally in the replenisher tank. A vessel loading mouth capable of holding a processing agent kit vessel obliquely to the surface of the processing solution is provided at an upper opening portion of said replenisher tank.

14 Claims, 3 Drawing Figures

AUTOMATIC PROCESSING MACHINE FOR PHOTOGRAPHY

BACKGROUND OF THE INVENTION

This invention relates to an automatic processing machine for processing of photographic light-sensitive materials.

More particularly, the present invention pertains to an automatic procesing machine which performs developing processing of photographic light-sensitive materials automatically, while replenishing a replenisher processing solution to a starting processing solution filled in a processing tank.

For processing of photographic light-sensitive materials by means of an automatic procesing machine while replenishing a replenisher processing solution (hereinafter referred to merely as replenisher solution), two kinds of processing solutions of a starting processing solution (hereinafter referred to merely as starting solution) and a replenisher solution are generally employed. When processing is started for the first time by means of an automatic procesing machine which has been carried in and installed or when the processing solution in the processing tank has been discarded for some reason, the processing tank is first filled with a starting solution, then a predetermined amount of a replenisher solution corresponding to the amount of the light-sensitive materials processed is replenished, and a part of the fatigued processing solution in the processing tank is discharged out from the overflow discharging outlet.

The starting solution and the replenisher solution are generally prepared by use of tanks for preparation of processing solutions called as mixing tanks etc. by dissolving or diluting a kit of processing agents with water. However, use of tanks for preparation of processing solutions requires a space for its installment or a working space for performing dissolving working thus bringing about inconveniences in working in a narrow place such as a small scale photofinishing laboratory for color photography. For the purpose of obviating such tanks for preparation of processing solutions which dissolve or dilute replenisher solutions, there has been proposed, for example, with respect to the replenisher solution, the so-called automatic replenishing device, in which the replenisher solution is prepared in a replenisher tank for storing the replenisher solution or the processing agent kit and water from a water supplying tank in amounts necessary for replenishing once or several times are metered and mixed before replenishing. However, according to the latter technique, the device employed will become too large to be suitable for an automatic processing machine to be used for a small scale photofinishing laboratory of photography with a small amount of processings. Accordingly, the present inventors, concerning the former technique, have previously proposed a replenisher tank which has enabled simple and instantaneous preparation of a replenisher solution. The previously proposed technique is a replenisher tank in an automatic processing machine which can prepare not only the replenisher solution but also the starting solution.

The present inventors have continued the study about the previously proposed technique and consequently found that, in the case when a part or all of the processing agent kit comprises a liquid agent, some troubles will occur in injecting the processing agent kit comprising said liquid agent into the replenisher tank.

To describe in detail, the replenisher tank according to said previously proposed technique has two or more tanks juxtaposed, and in injecting successively respective part liquid agents constituting the developing agent kit into one of said replenisher tanks, said liquid agent may sometimes be splashed against the liquid surface in the replenisher tank to cause liquid scattering, which may in turn be introduced into another replenisher tank adjacent thereto. Also, when part liquid agents are poured into the tank while holding them together with the vessel therefor, the pouring mouth of the vessel is required to be slanted accurately toward the upper opening of the replenisher tank. However, depending on the developing agent kit employed, even one part liquid agent may be as much as 2 to 3 liters, weighing up to some kilograms. It is a very tedious work to maintain the part liquid agent with such volume and weight at the correct pouring position over the period until pouring is completed. And, unless an extreme attention is paid, the part liquid agent may sometimes be unexpectedly splashed out vigorously to be mixed into another adjacent replenisher tank.

Developing processing of a photographic light-sensitive material, particularly a light-sensitive silver halide color photographic material without washing with water, when it is a positive type (posi-type), may be constituted of, for example, the respective steps of color developing, bleach-fixing and waterless rinsing. If, for example, a part liquid agent of the bleach-fixing replenisher solution or the bleach-fixing replenishing agent kit during preparation happens to be introduced into the adjacent tank of a color developing replenisher tank, it will have marked influence on the photographic performance of the finished print. Accordingly, all of said color developing replenisher solution is required to be discarded, and also the bleach-fixing replenisher solution must be prepared again, because no prescribed concentration can be attained therein.

Thus, liquid scattering or vigorous splashing out of the tank during preparation of processing solutions has marked influences not only on photographic performances, but also considerably harmful influences on human bodies anc clothings.

To review now prior art examples, as disclosed in Japanese Unexamined Utility Model Publication No. 52742/1981, there has been known the method in which the lids of the vessels for parts liquid agents of respective developing agent kits are constructed so as to be broken by piercing with a sharp member such as a needle and the like and said vessels are placed to stand toward the sharp member such as needle and the like provided in the replenisher tank. However, it is very difficult to perform the operation of placing the vessel upright upside down so that the breakable lid may be pierced with a sharp member such as a needle and the like when said vessel contains a part liquid agent having a great volume and weight. It is also disadvantageous in aspect of production cost to mount such a breakable lid for each vessel.

SUMMARY OF THE INVENTION

This invention has been accomplished with the background of the state of the art as described above, and an object of this invention is to provide an automatic processing machine for photography, which is capable of preparing rapidly without any trouble a processing solution for photographic light-sensitive materials.

Such an object of the present invention can be accomplished by an automatic processing machine for photography which performs developing processing of a photographic light-sensitive material automatically while replenishing a replenisher solution from a replenisher tank to a processing solution tank.

BRIEF DESCRIPTION OF THE DRAWINGS

FIG. 1 illustrates the relationship between the replenisher tank and the processing tank.

DESCRIPTION OF PREFERRED EMBODIMENTS

According to a preferred embodiment of the present invention, similarly as in the technique previously proposed, the replenisher tank is built in the automatic processing machine, and the developing processing of a photographic material is performed while the replenisher solution is prepared in said built-in type replenisher tank and said prepared replenisher solution is replenished to the processing tank. In the present invention, the replenisher tank may be constructed so that not only the replenisher solution but also the starting solution can be prepared in the replenisher tank. The present invention is described below in more detail below by referring to preferred embodiments, by which however the present invention is not limited at all.

Figure 1:
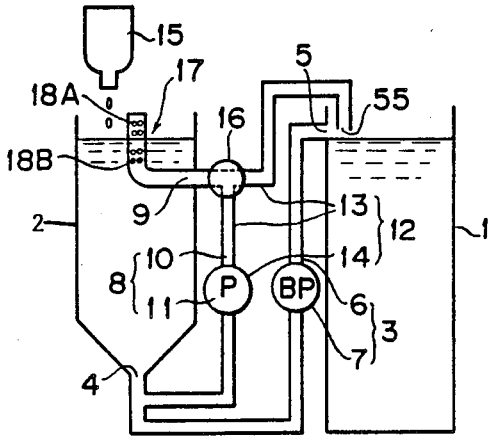
FIG. 1 and FIG. 2 show preferred embodiments of the replenisher tank used in the processing machine according to the present invention, respectively, each being a sectional view of the pertinent portion.
Figure 2:
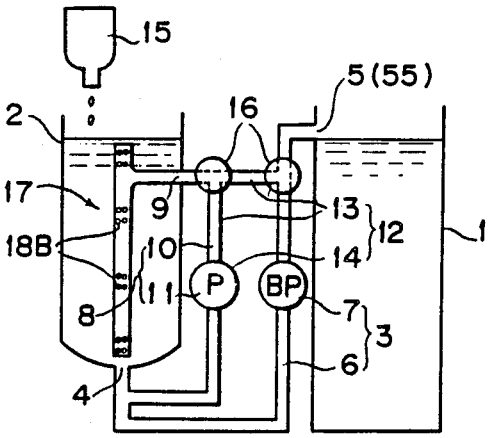

FIG. 1 and FIG. 2 show preferred embodiments of the replenisher tank used in the present invention, respectively, each being a sectional view of the pertinent portion illustrating the relationship between the replenisher tank and the processing tank. In each Figure, there is shown the case of the replenisher tank used in the present invention which is constructed so that a starting solution can also be prepared.

In each Figure, 1 is a processing tank, which performs one of the developing processing steps by passing a photographic light-sensitive material through said tank by means of a conveying means such as conveying rack etc. 2 is a replenisher tank relating to the present invention which supplements the replenisher solution to said processing tank 1. 3 is a means for delivering replenisher solution which delivers and supplements quantitatively the replenisher solution in said replenisher solution in tank 2 to said processing tank 1, and comprises a passage 6 communicating to the bottom opening 4 of the replenisher tank 2 with the upper opening 5 of the processing solution tank 1 and a constant delivery pump 7 such as bellows pump etc. provided in said passage 6. 8 is a means for circulating and stirring the processing solution, which stirs and mixes the processing solution in the replenisher tank 2 by circulation, and comprises a passage 10 communicating to the bottom opening 4 with the upper opening 9 (preferably below the liquid surface) of the replenisher tank 2 and a liquid delivering pump 11 provided in said passage 10. 12 is a means for delivering the starting solution prepared in the replenisher tank 2 and comprises a passage 13 communicating to the bottom opening 4 of the replenishing tank 2 with the upper opening 55 of the processing tank 1 and a liquid delivering pump 14 provided in said passage 13. In the Figures, 15 is a kit of developing agents (comprising one or two or more kinds of solutions or powder), and 16 is a three-way valve for change-over coupled to a pipe 17. As shown in FIG. 1, a pipe 17 having orifices 18A and 18B at portions thereof both above and below the liquid surface, is arranged approximately at the central portion in the replenisher tank 2. Alternatively, as shown in FIG. 2, the pipe 17 has orifices 18B only at portions thereof below the liquid surface.

The actions of the above respective embodiments are described as follows. A predetermined amount of a starting solution is prepared by stirring and mixing a predetermined amount of water introduced from the water supply tank (see FIG. 3) and a predetermined amount of processing agents from the processing agent kit 15 by permitting them to circulate through the passage 10 by actuation of the liquid delivering pump 11. Next, the liquid delivering pump 14 is actuated to deliver said starting solution in the replenisher tank 2 through the passage 13 to the processing tank 1 to fill the processing tank 1 with said starting solution. Subsequently, a predetermined amount of replenisher solution is prepared by stirring and mixing a predetermined amount of water introduced from the water supply tank etc. and a predetermined amount of processing agents from other processing agent kit 15 by permitting them to circulate through the passage 10 by actuation of the liquid delivering pump 11. Said replenisher solution is supplemented quantitatively intermittently (or continuously) through the actuation of the constant delivery pump 7 through the passage 6 into the processing tank 1 during running processing of a light-sensitive material in the processing tank 1. Of course, the three-way valve 16 for change-over is changed over for changing the passage to be used. Also, in replenishing the above replenisher solution to the processing tank 1, it may be supplemented so that the processing solution in said processing tank 1 may be overflowed from the overflow discharge outlet (not shown).

Automatic processing machines for photography, in the case when the photographic light-sensitive material to be processed is for color photography, generally have two or more processing tanks and replenisher tanks for carrying out the processes automatically, for example, color developing, bleach-fixing (or bleaching and fixing), stabilizing, waterless rinsing, etc. In this case, practicing of the tank construction according to the present invention in at least one replenisher tank will evidently belong to the technical scope of the present invention.

Figure 3:
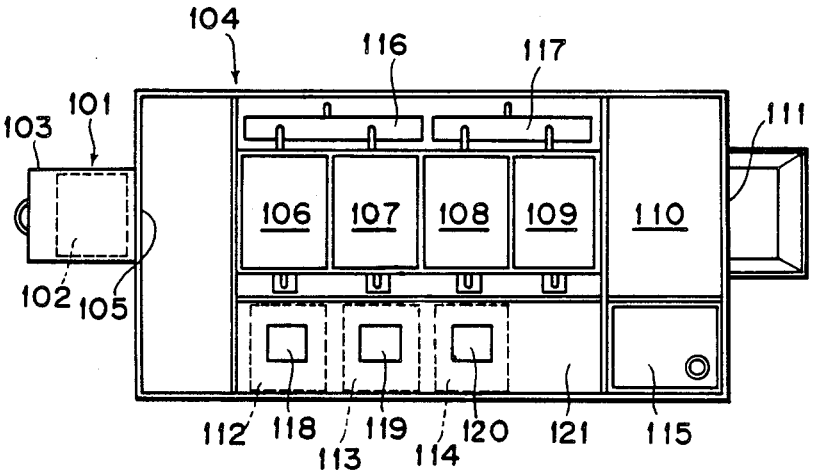
FIG. 3 is a schematic plan view of one example of an automatic processing machine according to the present invention.

The automatic processing machine for photography of the present invention preferably comprises a built-in type replenisher tank. FIG. 3 illustrates an embodiment of the processing machine of the present invention in which a processing tank, a replenisher tank, etc., explained in FIGS. 1 and 2 are incorporated. In FIG. 3, the printing paper 102 in the magazine 103 mounted on the mounting section 101 enters through the body inlet section 105 into the body 104, subjected automatically to developing processings through the developing tank 106, the bleach-fixing tank 107, the first rinsing tank 108 and the second rinsing tank 109, and then dried in the drying section 110 and taken out through the body outlet 111, followed optionally by other steps such as cutting and others at the sections above the body 104, to give a product print.

112, 113 and 114 designate replenisher tanks for the developer tank 106, the bleach-fixing tank 107 and the first rinsing tank 108 respectively. These replenisher tanks are constituted in such a manner as illustrated in FIGS. 1 and 2. The water supplying tank 115 (which can be omitted) containing water for diluting or dissolving processing agents stored therein is formed into a kit, and further the waste solution tank (not shown, positioned below the respective tanks 106–109 and the replenisher tanks 112–114) and/or the preliminary tanks 116, 117 (which can be omitted) are also detachably housed in the machine. In the Figure, 118, 119 and 120 show replenishing agent kits, and 121 shows a shelf for placing said kits 118, 119 and 120 which also functions as the opening-closing lid.

The present invention, having such a construction as described above, can accomplish the above-mentioned object, and exhibit excellent effects, and further requires no utility supplying means such as water pipe etc. and discharging pipe means for waste solution.

We claim:

1. In an automatic processing machine for photography which automatically performs developing processing of a photographic light-sensitive material, comprising a processing solution tank; a replenisher tank for receiving and containing a replenisher solution; and means for supplying replenisher solution from said replenisher tank to said processing solution tank to replenish processing solution in said processing solution tank;

the improvement wherein said replenisher tank comprises means (10,11) for stirring and mixing the replenisher solution in said replenisher tank, said stirring means including a passage (10) communicating a bottom opening (4) of said replenisher tank (2) with a top opening (9) of said replenisher tank, and a pipe section (17) coupled to said top opening (9), said pipe section (17) having orifices therein at least in the vicinity of a solution surface in said replenisher tank for introducing and mixing processing solution into said replenisher tank at least in the vicinity of the solution surface in said replenisher tank.

2. An automatic processing machine according to claim 1, wherein said stirring and mixing means further comprises a pump (11) in said passage (10) to pump liquid therethrough.

3. An automatic processing machine according to claim 1, wherein said supplying means comprises a supply pipe (6) communicating said replenisher tank with said processing solution tank.

4. An automatic processing machine according to claim 3, wherein said supplying means further comprises a pump (7) coupled to said supply pipe (6) for pumping said replenisher solution through said supply pipe (6).

5. An automatic processing machine according to claim 1, wherein said pipe section (17) comprises walls arranged in the vicinity of the solution surface in said replenisher tank, said walls having said orifices therein.

6. An automatic processing machine according to claim 5, wherein said pipe section (17) comprises a plurality of said orifices (18A) above the solution surface in said replenisher tank, and a further plurality of orifices (18B) arranged below said solution surface in said replenisher tank.

7. An automatic processing machine according to claim 1, wherein said pipe section (17) comprises a pipe member extending substantially vertically in said replenisher tank and having said orifices therein at least in the vicinity of said solution surface in said replenisher tank.

8. An automatic processing machine according to claim 7, wherein said pipe member extends below and above said solution surface, and wherein said orifices comprise a first plurality of orifices (18A) located above the solution surface in said replenisher tank, and a second plurality of orifices (18B) located below said solution surface in said replenisher tank.

9. An automatic processing machine according to claim 5, wherein said orifices (18B) located below said solution surface comprise a plurality of orifices located adjacent said solution surface.

10. An automatic processing machine according to claim 7, wherein said pipe member (17) extends only below said solution surface, and said orifices comprise only orifices (18B) located below said solution surface.

11. An automatic processing machine according to claim 10, wherein said pipe member (17) terminates short of said bottom opening (4) of said replenisher tank.

12. An automatic processing machine according to claim 11, wherein said pipe member (17) further comprises additional orifices therein near the bottom thereof and near said bottom opening (4) of said replenisher tank.

13. An automatic processing machine according to claim 12, wherein said top opening (9) of said replenisher tank opens ino said pipe section (17) between spaced pluralities of said orifices.

14. An automatic processing machine according to claim 11, wherein said top opening (9) of said replenisher tank opens into said pipe section (17) between spaced pluralities of said orifices.

* * * * *

UNITED STATES PATENT AND TRADEMARK OFFICE

CERTIFICATE OF CORRECTION

PATENT NO. : 4,705,378

DATED : Nov. 10, 1987

INVENTOR(S) : MIYAOKA et al

It is certified that error appears in the above-identified patent and that said Letters Patent is hereby corrected as shown below:

Title page, right-hand column, ABSTRACT, delete last sentence.

Signed and Sealed this

Seventeenth Day of January, 1989

*Attest:*

*Attesting Officer*

DONALD J. QUIGG

*Commissioner of Patents and Trademarks*